US007607810B2

(12) United States Patent
Collot

(10) Patent No.: US 7,607,810 B2
(45) Date of Patent: Oct. 27, 2009

(54) SIGNALLING LIGHT, IN PARTICULAR FOR AN AUTOMOBILE

(75) Inventor: Patrice Collot, Bobigny (FR)

(73) Assignee: Valeo Vision, Bobigny (FR)

( * ) Notice: Subject to any disclaimer, the term of this patent is extended or adjusted under 35 U.S.C. 154(b) by 0 days.

(21) Appl. No.: 11/231,547

(22) Filed: Sep. 20, 2005

(65) Prior Publication Data

US 2006/0062010 A1 Mar. 23, 2006

(30) Foreign Application Priority Data

Sep. 21, 2004 (FR) ..... 0409984

(51) Int. Cl.
*F21V 7/00* (2006.01)

(52) U.S. Cl. ..... 362/516; 362/297; 362/309; 362/346; 362/487; 362/509

(58) Field of Classification Search ..... 362/487, 362/498, 520, 539, 296, 346, 297, 304, 305, 362/307, 308, 309, 341, 347, 516–518, 509; 313/113, 114

See application file for complete search history.

(56) References Cited

U.S. PATENT DOCUMENTS

| | | | | | |
|---|---|---|---|---|---|
| 3,732,417 | A | * | 5/1973 | Nordquist | 362/309 |
| 3,900,727 | A | * | 8/1975 | Hutz | 362/263 |
| 3,944,810 | A | * | 3/1976 | Grindle | 362/297 |
| 4,420,800 | A | * | 12/1983 | Van Horn | 362/297 |
| 4,494,176 | A | * | 1/1985 | Sands et al. | 362/297 |
| 5,003,435 | A | * | 3/1991 | Nakata | 362/518 |
| 5,400,226 | A | * | 3/1995 | Hogrefe | 362/517 |
| 5,440,456 | A | * | 8/1995 | Bertling et al. | 362/520 |
| 5,945,916 | A | * | 8/1999 | Collot | 340/815.4 |
| 6,626,565 | B2 | * | 9/2003 | Ishida | 362/514 |

FOREIGN PATENT DOCUMENTS

| | | | |
|---|---|---|---|
| DE | 3035005 | | 4/1982 |
| DE | 3035005 | A * | 4/1982 |
| FR | 2141789 | | 1/1973 |
| FR | 2 745 365 | | 8/1997 |
| FR | 2745364 | | 8/1997 |
| FR | 002745364 | A1 * | 8/1997 |

OTHER PUBLICATIONS

Dialog Abstract for FR 2 745 365.
French Search Report dated May 3, 2005.

* cited by examiner

*Primary Examiner*—Anabel Ton
*Assistant Examiner*—Kevin J. Spinella
(74) *Attorney, Agent, or Firm*—Locke Lord Bissell & Liddell LLP

(57) ABSTRACT

A compact vehicle signalling light having a multi-reflector concave mirror which provides maximum light yield. The mirror includes a first reflector which is convergent and enveloping with respect to the light source and a second reflector formed near the apex of the mirror which reflects light rays passing around the light source without interfering with it. The vehicle light further includes a lens which cooperates with the reflectors to generate a light beam which complies with regulatory standards.

18 Claims, 5 Drawing Sheets

SIGNALLING LIGHT, IN PARTICULAR FOR AN AUTOMOBILE

FIELD OF THE INVENTION

The invention relates to a lighting and/or signalling device for a vehicle, in particular a signalling device for an automobile, of the type that comprises: a concave mirror of revolution about the optical axis having a focus on this axis; a light source disposed at the focus or in the vicinity; and a lens situated in front of the light source.

BACKGROUND OF THE INVENTION

A signalling light of this type is known in particular from FR-A-2745365. Such a signalling light can serve to indicate a change in direction, a reversing light or any other light used on an automobile.

The aim of the invention is in particular to provide a signalling light of small size having a maximum light yield so that it is possible to obtain a high level of performance in a small space, with a light source of low power, having regard to thermal and service-life requirements.

In particular, it is wished to produce a direction indicator of category 500 Cd (candelas) having the smallest possible dimensions with a light source consisting of a 16 W (watts) HiPer lamp.

It is also desirable for the solution proposed to make it possible to capture a high light flux whatever the orientation, axial or transverse, of the filament of the light source.

SUMMARY OF THE INVENTION

The object of the invention is a signalling light, in particular for an automobile, comprising: a concave mirror about the optical axis and a focus on this axis; a light source disposed at the focus or in the vicinity; a lens situated in front of the light source. In accordance with the invention the lens is designed to straighten up the light rays coming from the mirror and the mirror comprises a mirror that is convergent and enveloping with respect to the light source, the lens being formed by a disc made from transparent material orthogonal to the optical axis and centred on this axis, a face of the disc comprising prisms or blocks operating by refraction in order to straighten up the light rays.

According to the invention, the term "light" is used, for reasons of conciseness, to designate any lighting and/or signalling device for vehicles.

According to the invention, "converging" mirror means a mirror such that, if the straight line passing through the optical axis and the focus is considered, the rays reflected by the said mirror converge towards a point on this straight line.

According to the invention, "straightening up the light rays" means repositioning the rays in a direction close to the optical axis, or attenuating their convergence, so that, on average, in being diverted they approach an orientation parallel to the optical axis.

Advantageously, the mirror has an internal surface of revolution with a convergent meridian. The meridian of the internal surface of the mirror is an arc of a curve or an arc of a conic section, the conic section having a focus merged with that of the reflector.

Preferably the mirror comprises a reflector with an internal surface of revolution having a meridian formed by an arc of a conic section whose geometric axis is inclined by an angle, with respect to the axis of revolution, in a direction that makes the reflector enveloping with respect to the light source, the conic section having a focus merged with that of the reflector.

The conic section arc is preferably an arc of a parabola.

The inclination of the meridian to the optical axis makes it possible to bring the reflecting surface close to the optical axis and therefore to make it more enveloping in order to capture much more light flux than with a conventional reflector of revolution.

The mirror generally comprises an opening in its bottom, in particular for the passage of the electrical supply for the light source; advantageously, the reflector is extended in the area of the bottom by a second reflector formed by a ring of revolution about the optical axis. Preferably, this ring has as its meridian an arc of a parabola whose geometric axis is merged with the optical axis.

The focus of the parabolic ring is preferably merged with the focus of the first reflector.

The intersection line between the first and second reflectors is a circle whose plane is orthogonal to the optical axis, this circle constituting the base of a cone of revolution having its vertex on the optical axis, with a half angle at the vertex equal to the angle of inclination of the geometric axis of the meridian of the first reflector, this cone passing around the globe of the light source, without interfering with it.

The angle of inclination of the geometric axis of the meridian of the first reflector with respect to the optical axis is preferably between 10° and 30°, especially between 15° and 25°, in particular equal to or approximately 20°.

The lens situated in front of the source is designed to straighten up the light rays coming from the mirror and thus form a beam in accordance with the regulatory requirements.

Advantageously, the prisms can be distributed in concentric circular rings, divided into several angular sectors, in particular symmetrical in pairs either with respect to a vertical axial plane or with respect to a horizontal axial plane.

The prisms are advantageously designed to straighten up the light rays more and more on moving away from the optical axis.

The faces of the prisms or blocks can be curved, in particular in two orthogonal directions in order to ensure vertical and horizontal diversion.

The invention consists, apart from the provisions disclosed above, of a certain number of other provisions that will be dealt with more explicitly below with regard to an example embodiment described with reference to the accompanying drawings but which is in no way limiting. In these drawings:

DESCRIPTION OF THE PREFERRED EMBODIMENTS

Figure 1:
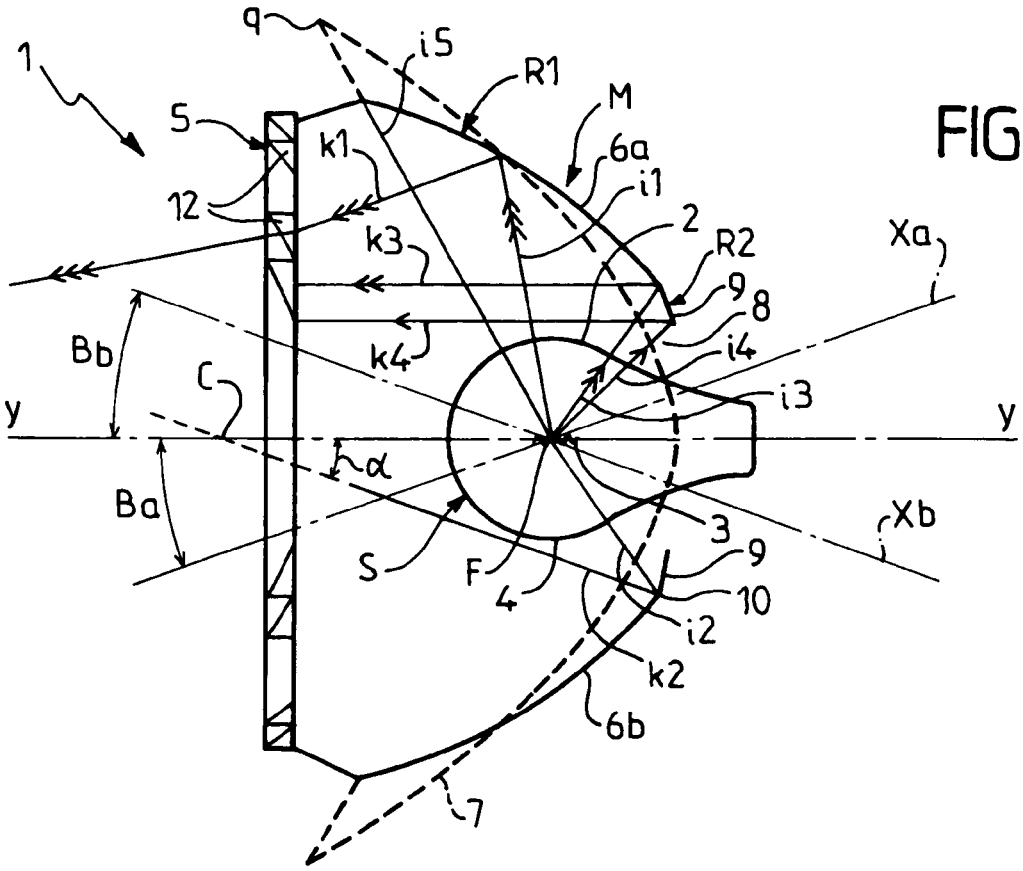
FIG. 1 is a schematic axial vertical section of a signalling light according to the invention.

Referring to FIG. 1 of the drawings, a signalling light 1, for an automobile, can be seen, which comprises a concave mirror M of the paraboloid type. The mirror M is of revolution about the optical axis Y-Y of the light and has a focus F on this optical axis.

The light source S is disposed at the focus F or in its vicinity. The light source S advantageously consists of a 16 W HiPer lamp having a small globe 4 or bulb made from transparent material, in particular glass, substantially spherical, with a maximum diameter of approximately 18 mm. Such a lamp has an axial filament 3 that passes through focus F or close to it. However, it would be possible to use a lamp with a transverse filament, for example a white H21 lamp, in which case it will be necessary to provide a coloured screen. When a coloured lamp is used the lens 5 can be made from transparent material.

The light source can also consist of one or more light emitting diodes or LEDs that illuminate laterally.

A lens 5 is situated in front of the light source, in the direction of propagation of the light rays.

The mirror M comprises a first reflector R1 having a reflective internal surface of revolution about the optical axis Y-Y. According to the invention, the meridian of the reflective surface of R1 is formed by an arc of a parabola 6*a* whose geometric axis Xa is inclined by an angle Ba with respect to the optical axis Y-Y (axis of revolution) in a direction that makes the reflector R1 enveloping with respect to the light source S.

The intersection of the reflective surface of the reflector R1 by the axial vertical plane also comprises another arc of a parabola 6*b* symmetrical with the first with respect to the axis Y-Y. The geometric axis Xb of the arc 6*b* is inclined by an angle Bb=Ba to the optical axis Y-Y in a direction opposite to that of the arc 6*a*. It should be noted that the two arcs 6*a*, 6*b* do not belong to the same parabola.

The angle Ba is preferably between 15° and 25° and is in particular equal to 20°.

The inclination of the arcs of a parabola 6*a*, 6*b* in accordance with the angles Ba, Bb makes it possible to capture as much light flux as a conventional paraboloid of revolution 7 shown in broken lines and whose opening diameter would be greater than that of the reflector R1. This is because, in FIG. 1, the extreme light ray i5 recovered by the reflector R1 could be recovered by the conventional parabolic system 7 only for a greater diameter corresponding to the intersection q of the extension of i5 with the parabola 7.

According to another formulation, the inclination of the arcs 6*a*, 6*b* makes it possible to capture much more light flux than with a conventional paraboloid of revolution that would have the same maximum diameter.

The geometric focus of the arcs of a parabola such as 6*a*, 6*b* is merged with the focus F of the signalling light.

A light ray i1 issuing from the focus F and directed towards the arc 6*a* is reflected along the ray k1 parallel to the geometric axis Xa of the arc 6*a*.

A light ray i2 issuing from F and falling on the arc 6*b* is reflected along the ray k2 parallel to the geometric axis Xb of the arc 6*b*.

Substantially the same applies to the points of the light source situated in the vicinity of the focus F.

The light beam issuing from the reflector R1 will therefore be essentially conical with its vertex situated on the optical axis Y-Y.

The mirror M has, in its bottom, an opening 8 for the passage of the cap of the source S and its support. In this bottom area, the mirror M comprises a second reflector R2 formed by a parabolic ring of revolution about the optical axis Y-Y. This ring has as its meridian an arc of a parabola 9 whose geometric axis is merged with the optical axis Y-Y and whose focus is merged with F. The two arcs 9 of the parabolic ring R2 situated in the vertical intersection plane of FIG. 1 belong to the same parabola, which was not the case with the arcs 6*a*, 6*b*.

Two light rays i3, i4 issuing from the focus F and falling on the ends of an arc 9 are reflected along the rays k3, k4, parallel to the optical axis Y-Y.

The connection line 10 between the first reflector R1 and the second reflector R2 is a circle whose plane is orthogonal to the optical axis Y-Y. The diameter of this circle 10 is chosen so that the light rays i2 issuing from the focus F and reflected by the area of the meridians 6*a*, 6*b* adjacent to the intersection line 10 are not intercepted by the globe 4. A loss of light flux is thus avoided. The circle 10 constitutes the base of a cone of revolution having its vertex C on the optical axis with a half angle $\alpha$ at the vertex equal to the angle of inclination Bb=Ba of the geometric axis of the meridian 6*a* of the first reflector; this cone passes around the globe 4 of the lamp 2 without interfering with it. The surface of the cone is external or tangent to the globe 4.

The smallest diameter of the parabolic ring 9, corresponding to the edge of the opening 8, is chosen so that a ray such as k4 reflected by the radially internal edge of the ring 9 remains separated from the globe 4 so as not to be intercepted.

The parabolic ring of revolution 9 makes it possible to obtain a parallel beam that does not converge in the lamp 2, which avoids a loss of light flux.

Figure 3:
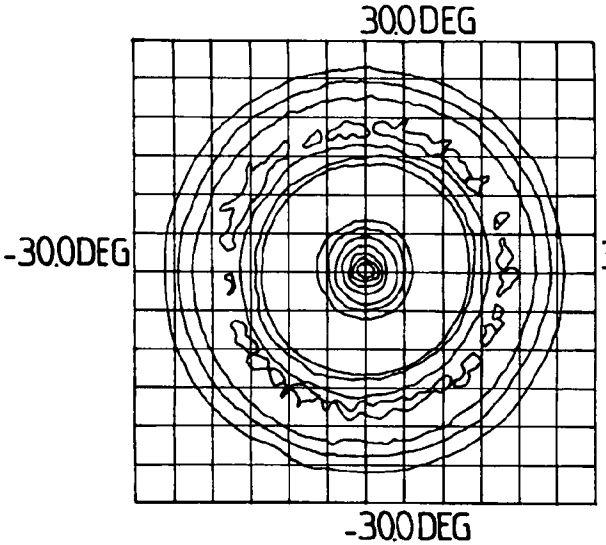
FIG. 3 illustrates the isolux curves, on a projection screen, produced by the mirror alone, the lens being removed.

The beam obtained by means of the reflectors R1 and R2 and the sources S produces a network of isolux curves, as illustrated in FIG. 3 on a projection screen situated at a given distance from the light and orthogonal to the optical axis Y-Y. The graduations of the screen correspond to the angle formed between the optical axis, which cuts the screen at the centre, and a straight line passing through the focus and cutting the screen at the graduation in question. These graduations extend from −30° to +30° both in the horizontal transverse direction and in the vertical direction.

The isoluxes obtained with the source S and the mirror M are formed substantially by circles centred on the optical axis Y-Y. The greatest elimination is obtained close to this axis.

Figure 16:
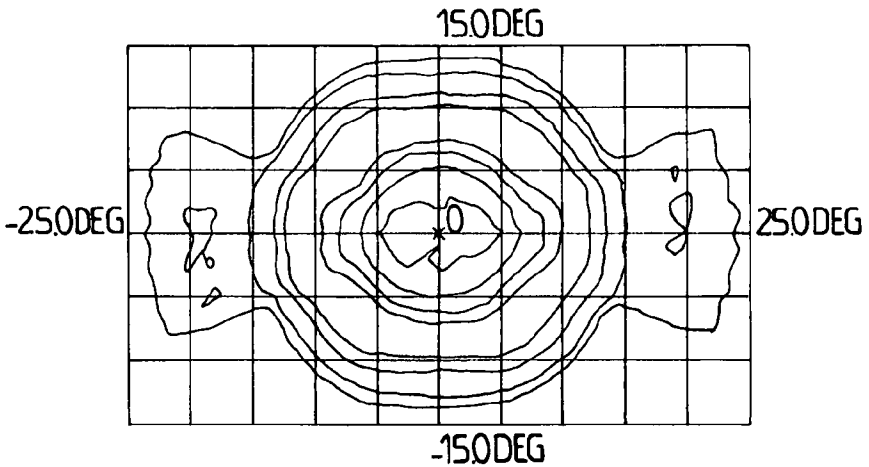
FIG. 16 illustrates the isolux curves of the signalling light according to the invention, provided with its lens.

Such a distribution of the light flux does not satisfy the regulatory requirements according to which the isoluxes must form substantially a cross spread horizontally as illustrated in FIG. 16.

The lens 5 disposed in front of the source S is designed to straighten up the light rays and form a beam in accordance with the legislation according to FIG. 16.

Figure 2:
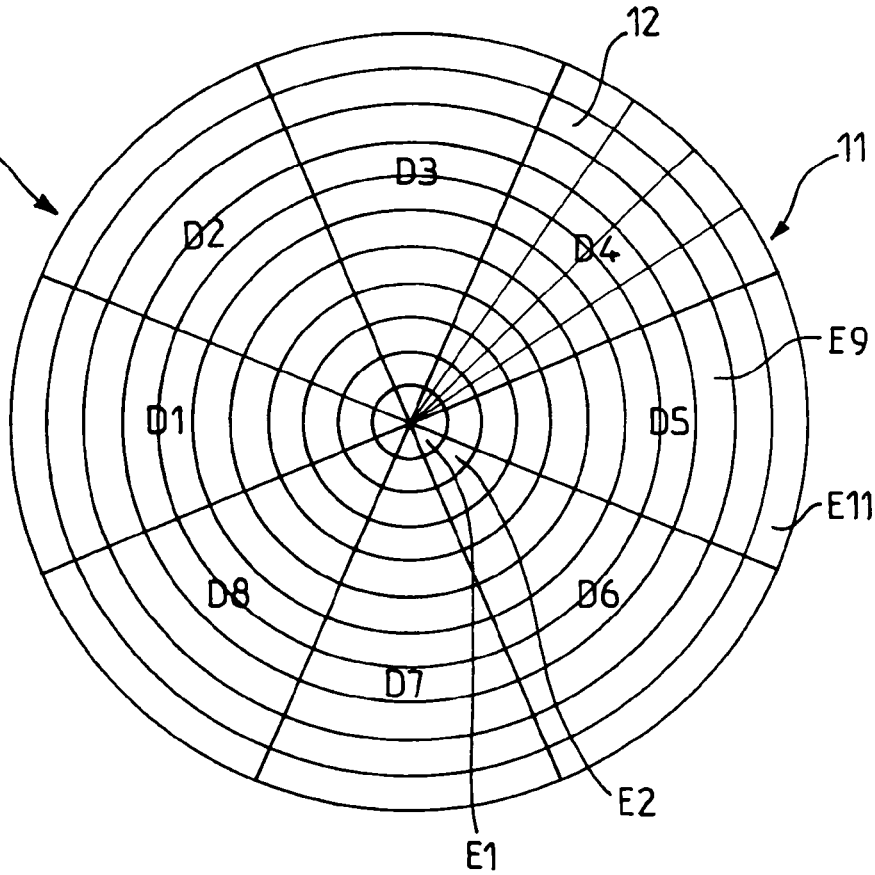
FIG. 2 is a schematic front view, to a larger scale, of the lens of the light in FIG. 1.

The lens 5 is formed by a disc 11 (see FIG. 2) made from transparent material, in particular made from plastics material or glass, orthogonal to the optical axis and centred on this axis.

The front face of the disc 11 comprises prisms 12 or, more generally, pads or blocks for straightening up the light rays in order to obtain the network of FIG. 16.

Each prism 12 is oriented so as to give the required photometric pattern.

By way of non-limiting example, the front face of the disc 11 is divided into eleven concentric rings E1-E11 with the same radial width. The width of the rings will depend on the required style for the signalling light. The pitch may be approximately 2.5 mm. The protrusion created by the prisms or blocks 12 may be around 1 mm.

The disc 11 is also divided into eight angular sectors D1, D2, . . . D8 each of 45°. Each sector is divided radially into four elementary areas of the same angular extent, which has been shown only for sector D4, for reasons of clarity of the drawing, but all the other sectors are divided like D4. A prism 12 corresponds to the intersection of an elementary area and a ring.

The sector D5 is symmetrical with the sector D1 with respect to the vertical plane passing through the optical axis.

The sectors D3 and D7 are symmetrical with each other with respect to the horizontal plane passing through the optical axis.

The sector D2 lies between the sectors D1 and D3 whilst the sector D6 lies between the sectors D5 and D7.

The sectors D4 and D8 lie respectively between the sectors D3, D5 and D1, D7.

The prisms 12 can be straight prisms whose base (the hypotenuse of the section in a right-angled triangle) is turned towards the outside whilst being inclined to the optical axis. The inclination of the base is variable, according to the distance to the optical axis, in order to modulate the straightening up of the rays reflected according to requirements.

In an annular area corresponding to the ring 9 and to the beam of parallel rays k3, k4, the blocks are designed to take account of this parallel beam.

The faces of the prisms or blocks 12 can be curved in particular in two orthogonal directions in order to provide a vertical or horizontal diversion.

It is possible to provide a serrated glass in front of the lens 5. In this case, account is taken of this serrated glass in producing the lens 5.

Figure 4:
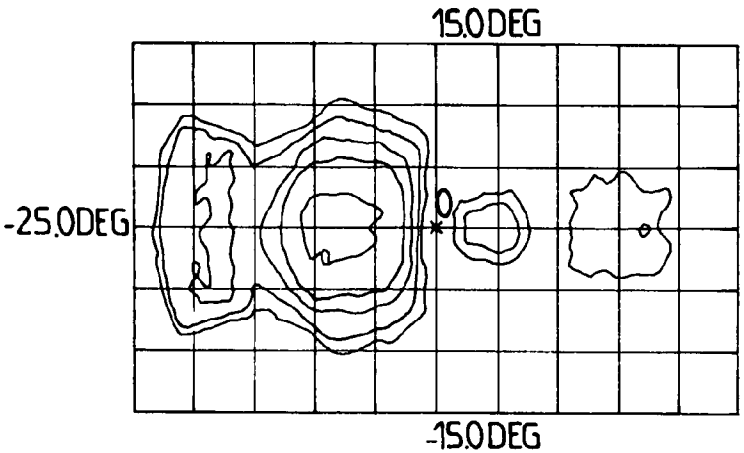
FIG. 4 illustrates the isolux curves of the signalling light corresponding solely to sector D1 of the lens.

The sector D1 of the lens 5, combined with the source S and the mirror M, gives the network of isolux curves illustrated in FIG. 4. The maximum illumination area, corresponding to the internal curve of the network, is situated in the horizontal direction substantially between −5° and −12° and in the vertical direction between −3° and +30°.

Figure 5:
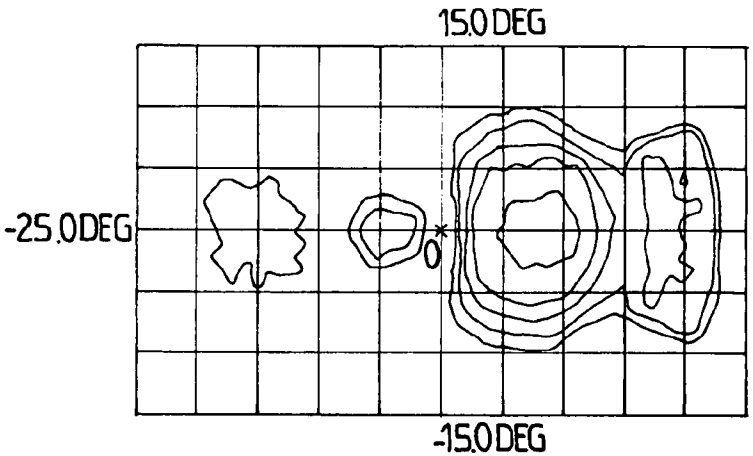
FIG. 5 illustrates the isolux curves corresponding solely to sector D5 of the lens.

The sector D5 gives a substantially symmetrical configuration, illustrated in FIG. 5, of the network of D1 with respect to the vertical plane passing through the optical axis, with a maximum illumination area lying horizontally substantially between +5° and +12° and vertically between −3° and +3°.

Figure 6:
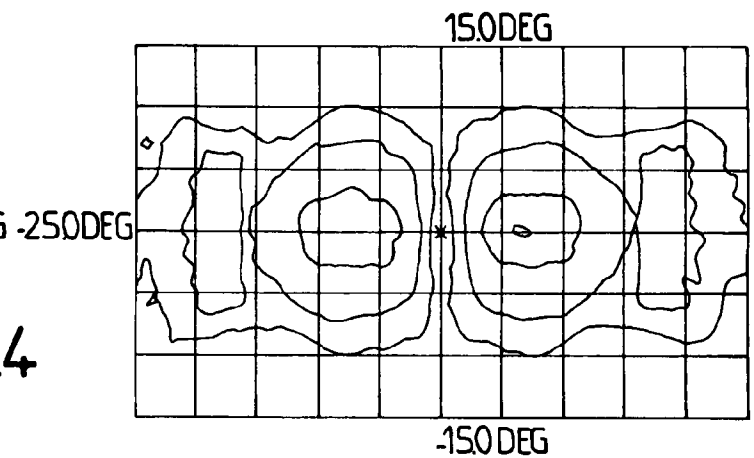
FIG. 6 illustrates the isolux curves resulting from the addition of sections D1 and D5.

The addition of the sectors D1 and D5 gives the network of isoluxes illustrated in FIG. 6 which extends essentially horizontally.

Figure 7:
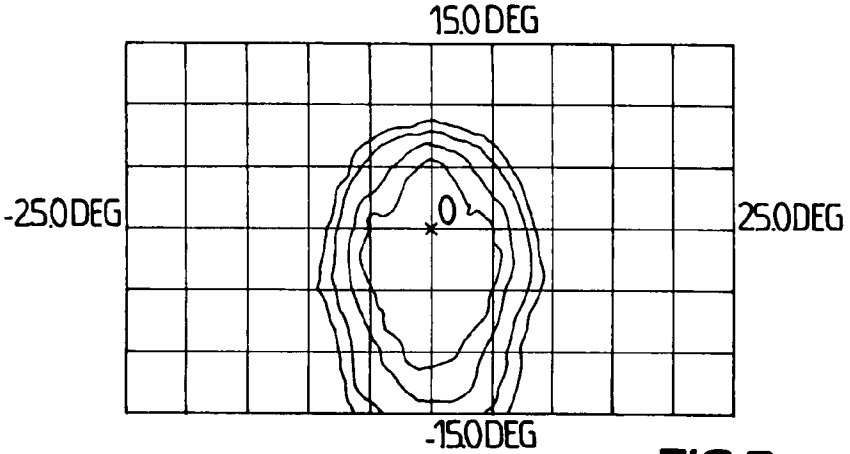
FIG. 7 illustrates the isolux curves corresponding to sector D3 of the lens.

The sector D3 gives the network of isoluxes illustrated in FIG. 7 with a maximum illumination area (internal curve) lying horizontally substantially between −6° and +6° and vertically between −12° and +5°.

Figure 9:
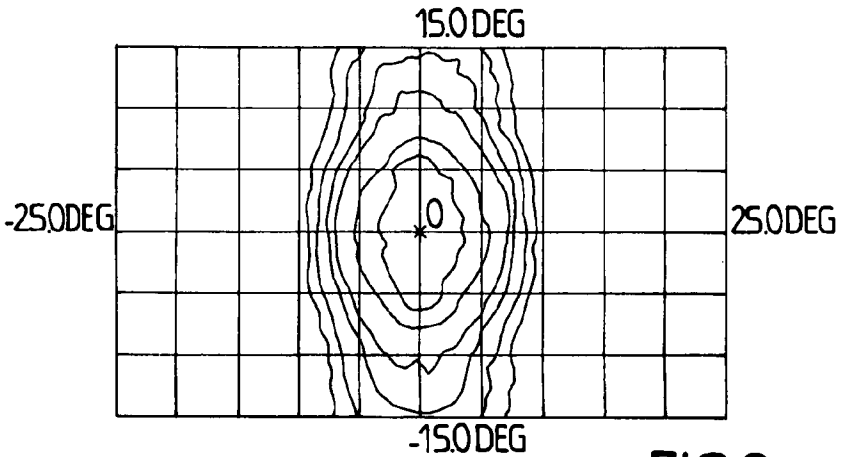
FIG. 9 illustrates the isolux curves corresponding to the addition of sections D3 and D5.
Figure 8:
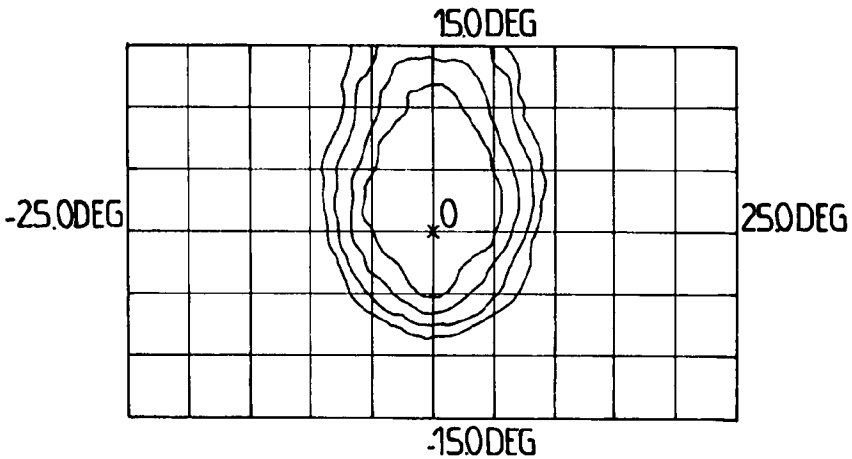
FIG. 8 illustrates the isolux curves corresponding to sector D7.

The sector D7 gives the network of isoluxes illustrated in FIG. 8 which is substantially symmetrical with the network of sector D3 with respect to the horizontal plane passing through the optical axis. The addition of the networks of sectors D3 and D7, illustrated in FIG. 9, gives an illumination oriented principally in the vertical direction.

Figure 10:
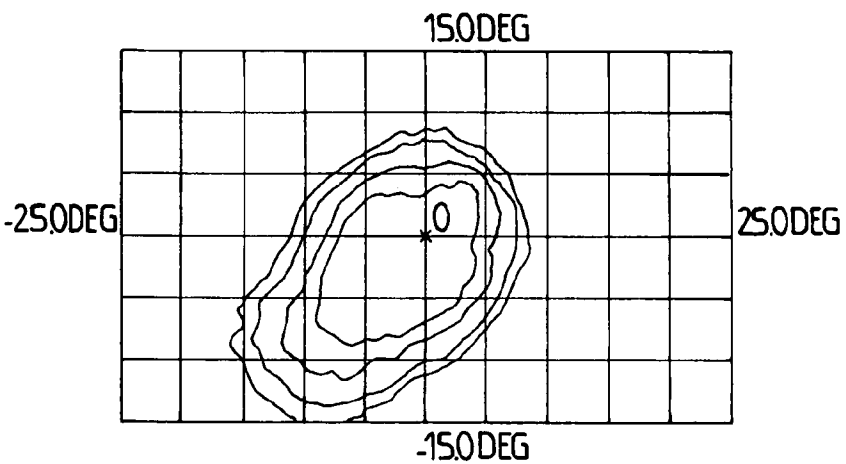
FIG. 10 illustrates the isolux curves corresponding to sector D2 of the optical screen.

The sector D2 gives the network of isoluxes illustrated in FIG. 10. The network has an average direction inclined by 45° from top to bottom, from right to left, and the maximum illumination area is, in the horizontal direction, substantially between −8° and +4° and, in the vertical direction, between −8° and +4°.

Figure 11:
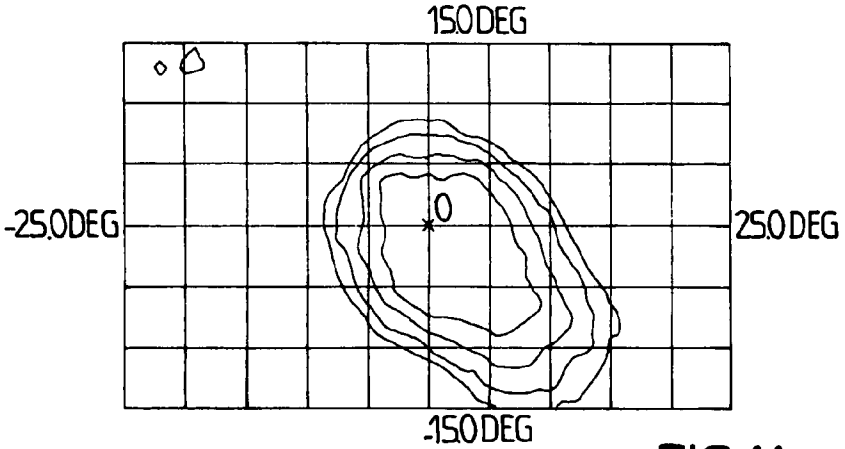
FIG. 11 illustrates the isolux curves corresponding to sector D4 of the lens.

The sector D4 gives a network of isoluxes illustrated in FIG. 11 practically symmetrical with the network of sector D2 (FIG. 12) with respect to the vertical plane passing through the optical axis.

Figure 12:
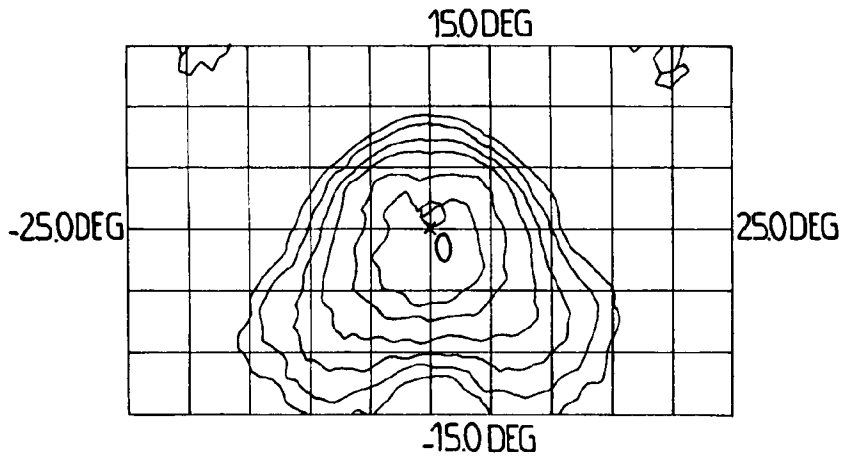
FIG. 12 illustrates the isolux curves resulting from the addition of sectors D2 and D4.

The combination of the isolux curves produced by the sectors D2 (FIG. 10) and D4 (FIG. 11) is illustrated in FIG. 12. The maximum illumination area is horizontally substantially between −5° and +5° and vertically substantially between −7° and +3°. The isolux curves surround this main area with two branches extending downwards on each side of the vertical plane substantially at an inclination of 45°.

Figure 13:
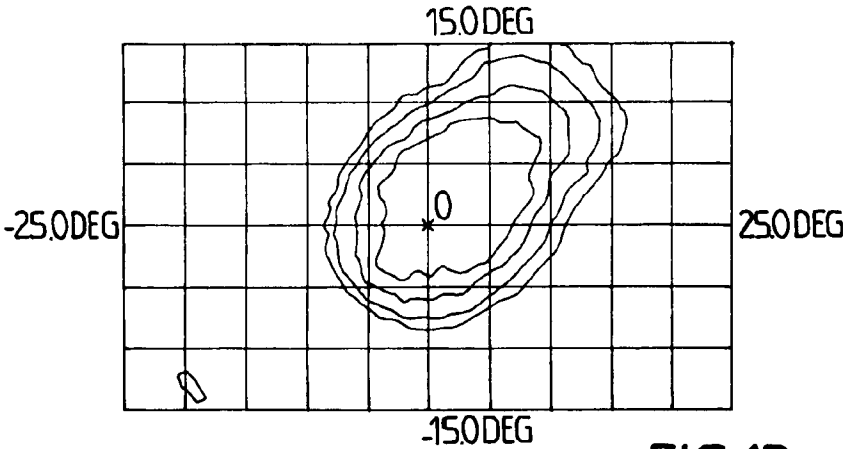
FIGS. 13 and 14 illustrate the isolux curves respectively of sectors D6 and D8 of the lens.

The network of isolux curves coming from the sector D6 is illustrated in FIG. 13 and has an average direction inclined substantially at 45° from bottom to top and from left to right.

Figure 14:
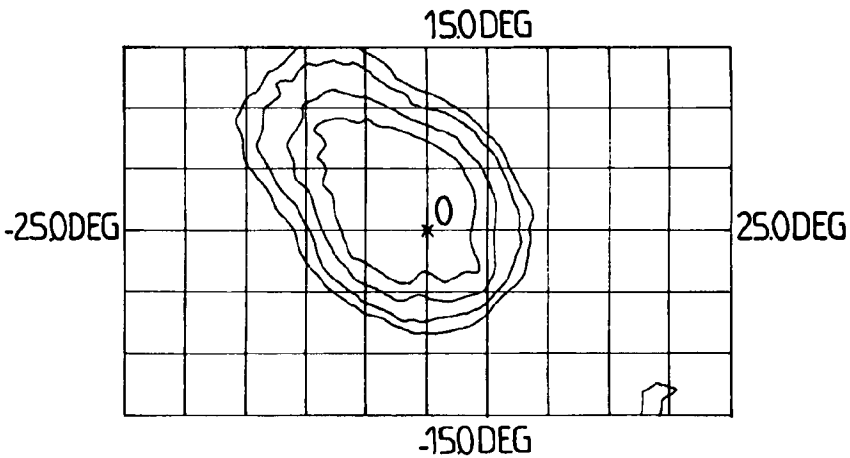

The network of isolux curves of sector D8 is substantially symmetrical with that of sector D6 with respect to the vertical plane passing through the optical axis, as illustrated in FIG. 14.

Figure 15:
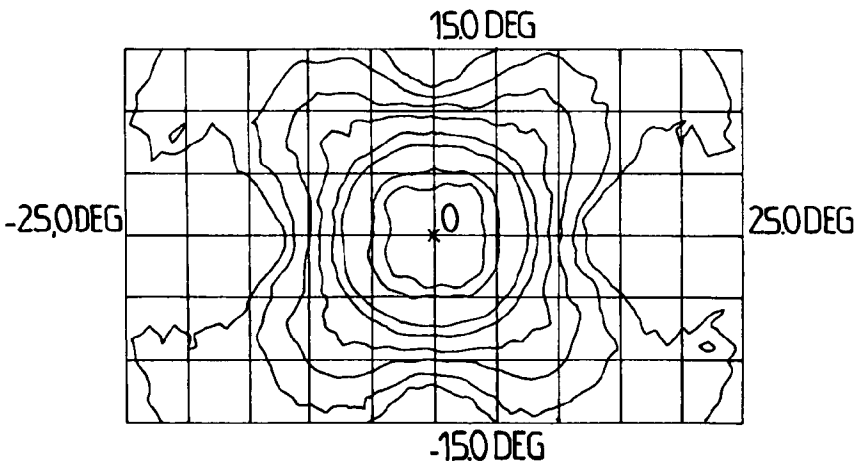
FIG. 15 illustrates the isolux curves resulting from the addition of sectors D2, D4, D6 and D8.

The network of isolux curves resulting from the combination of sectors D2 (FIG. 11), D4 (FIG. 12), D6 (FIG. 13) and D8 (FIG. 14) is illustrated in FIG. 15 and has an average line substantially in the form of an X centred on the optical axis, the maximum illumination being situated in the central area.

FIG. 16 illustrates the network of isolux curves obtained with the signalling light according to the invention equipped with the lens 5. The isolux curves are spread horizontally and close together vertically, so as to satisfy the regulatory requirements.

The invention applies to a signalling light in general including a main-beam headlight.

With a reflector R1 with a maximum diameter of 63 mm, a light flux equivalent to that of a conventional parabolic headlight having a maximum diameter of 93 mm is recovered.

If the reflector R1 is extended, the lens 5, instead of being situated in a plane, may be concave towards the front in order to avoid two impingements on the same optical block or pad.

In a light according to the invention, if the lens 5 does not exactly occupy the expected position, a major drawback does not result from this: only the photometric pattern and the network of isolux curves are slightly turned. Positive location is provided for the positioning of the lens 5, even if a mounting defect of this lens is not very sensitive. This would not be the case for the mounting of a lens at the front of a reflector of the ellipsoidal type, very sensitive to a mounting defect of the converging lens situated at the front of the reflector.

The description has been given in the case where the arc of a conic section constituting the meridian 6*a*, 6*b* of the reflector R1 is an arc of a parabola. It would however be possible to provide another type of conic section, for example an arc of an ellipse whose focus will be situated at the point F and the other focus situated in front of the light.

What is claimed is:

1. Signaling light for an automobile, comprising:

(a) a light source comprising a bulb and a filament;

(b) a concave mirror having an optical axis and a focus on the optical axis; the mirror having an apex and an opening formed therein, comprising:

i) a first reflector having an internal surface of revolution about the optical axis spanning the circumference of the opening at the apex of the mirror, the internal surface of revolution having a convergent meridian comprising an arc of a conic section having a geometric axis inclined by an angle with respect to the optical axis, the filament being disposed at or in the vicinity of the focus and the first reflector being convergent and enveloping with respect to the light source; and ii) a second reflector in the form of a concentric ring having an inner edge extending along the opening at the apex of the mirror and an outer edge coupled to the first reflector along an intersection line, the second reflector having an internal surface of revolution about the optical axis, the internal surface of revolution having a meridian comprising an arc of a parabola having a geometric axis is parallel to the optical axis; and (c) a lens disposed in front of the light source, which alters the direction of the light rays reflected from the mirror, the lens comprising a disc of transparent material defining a plane disposed orthogonal to the optical axis and centered on the optical axis, a face of the disc comprising prisms or blocks which refract the light rays.

2. Signaling light according to claim 1, wherein the mirror has an internal surface of revolution having a convergent meridian.

3. Signaling light according to claim 2, wherein the meridian of the internal surface of the mirror is an arc of a curve or an arc of a conic section, the conic section having a focus merged with that of the first reflector.

4. Signaling light according to claim 3, wherein the conic section arc is an arc of a parabola.

5. Signaling light according to claim 1, wherein the focus of the second reflector is merged with the focus of the first reflector.

6. Signaling light according to claim 1, wherein the intersection line between the first and second reflector is a circle whose plane is orthogonal to the optical axis, this circle constituting the base of a cone of revolution having its vertex on the optical axis with a half angle at the vertex equal to the angle of inclination of the geometric axis of the meridian of the first reflector, this cone passing around the globe of the light source, without interfering with it.

7. Signaling light according to claim 1, wherein the angle of inclination of the geometric axis of the meridian of the first reflector with respect to the optical axis is between 10° and 30°.

8. Signaling light according to claim 1, wherein the prisms or blocks are distributed in concentric circular rings, divided into a plurality of angular sectors.

9. Signaling light according to claim 8, wherein the angular sectors are symmetrical in pairs either with respect to a vertical axial plane, or with respect to a horizontal axial plane.

10. Signaling light according to claim 1, wherein the prisms or blocks are designed to straighten up the light rays more and more on moving away from the optical axis.

11. Signaling light according to claim 1, wherein the faces of the prisms or blocks are curved, in particular in two orthogonal directions, in order to ensure vertical and horizontal diversion.

12. Signaling light according to claim 1, wherein the angle of inclination of the geometric axis of the meridian of the first reflector with respect to the optical axis is between 15° and 25°.

13. Signaling light according to claim 1, wherein the angle of inclination of the geometric axis of the meridian of the first reflector with respect to the optical axis is approximately 20°.

14. Signaling light according to claim 9, wherein the angular sectors comprise eight angular sectors.

15. Signaling light according to claim 14, wherein a first angular sector is symmetrical with a fifth angular sector with respect to a vertical plane passing through the optical axis and wherein the first and fifth angular sectors combine to produce an isolux network which extends essentially horizontally.

16. Signaling light according to claim 15, wherein a third angular sector is symmetrical with a seventh angular sector with respect to a horizontal plane passing through the optical axis and wherein the third and seventh angular sectors combine to produce an isolux network which extends essentially vertically.

17. Signaling light according to claim 16, wherein a second angular sector is symmetrical with a sixth angular sector and a fourth angular sector is symmetrical with an eighth angular sector and wherein the second and sixth and fourth angular sectors combine to produce an isolux network which extends essentially diagonally at an angle of approximately 45 degrees with respect to the horizontal plane passing through the optical axis and the fourth and eighth angular sectors combine to produce an isolux network which extends essentially diagonally at an angle of approximately 45 degrees to the horizontal plane passing through the optical axis.

18. Signaling light according to claim 17, wherein the second, fourth, sixth and eighth angular sectors combine to produce an isolux network having a maximum illumination situated along the optical axis.

* * * * *